US005697611A

United States Patent [19]

Kelly et al.

[11] Patent Number: 5,697,611

[45] Date of Patent: Dec. 16, 1997

[54] REDEMPTION-TYPE ARCADE GAME WITH GAME TOKEN RETURN

[75] Inventors: Matthew F. Kelly, San Ramon, Calif.; J. Richard Oltmann, Scottsdale, Ariz.

[73] Assignee: RLT Acquisition, Inc., Pleasanton, Calif.

[21] Appl. No.: 374,490

[22] Filed: Jan. 17, 1995

[51] Int. Cl.[6] ..... A63F 7/02

[52] U.S. Cl. ..... 273/126 A; 273/138.2; 273/138.3

[58] Field of Search ..... 273/440, 448, 273/138 R, 138 A, 138.1, 138.2, 138.3, 121 B, 143 R, 126 A, 126 R, 454

[56] References Cited

U.S. PATENT DOCUMENTS

| | | | |
|---|---|---|---|
| 473,265 | 4/1892 | Reisky . | |
| 810,299 | 1/1906 | Pettee . | |
| 941,194 | 11/1909 | Hamilton . | |
| 1,543,318 | 6/1925 | Cardoza . | |
| 1,563,983 | 12/1925 | Higuchi . | |
| 1,572,090 | 2/1926 | Smith | 273/138.3 X |
| 1,652,071 | 12/1927 | Tsujino . | |
| 1,663,752 | 3/1928 | Fleisher | 273/138.3 |
| 1,879,511 | 11/1932 | Rodgers . | |
| 2,043,166 | 6/1936 | Hart et al. | 273/138 |
| 2,141,580 | 12/1938 | White | 273/95 |
| 2,660,434 | 11/1953 | Durant | 273/121 |
| 2,736,559 | 2/1956 | Turner | 273/125 |
| 2,926,915 | 3/1960 | Johns | 273/95 |
| 3,268,227 | 8/1966 | Thatcher, Jr. | 273/108 |
| 3,275,324 | 9/1966 | Burnside | 273/126 |
| 3,275,325 | 9/1966 | MacKenzie | 273/179 |
| 3,429,574 | 2/1969 | Williams | 273/123 |
| 3,584,877 | 6/1971 | Florian | 273/176 FB |
| 3,807,736 | 4/1974 | Goldfarb et al. | 273/122 R |
| 3,843,129 | 10/1974 | Dietrich | 273/120 R |
| 3,851,879 | 12/1974 | Hicks | 273/120 R |
| 3,947,030 | 3/1976 | Goldfarb et al. | 273/85 R |
| 4,120,501 | 10/1978 | Atherton | 273/120 R |
| 4,212,465 | 7/1980 | Arad | 273/121 A |
| 4,216,961 | 8/1980 | McQuillan | 273/89 |
| 4,227,690 | 10/1980 | Pitkanen | 273/1 R |
| 4,240,635 | 12/1980 | Brown | 273/138 A |
| 4,260,153 | 4/1981 | Nishimiya | 273/89 |
| 4,348,028 | 9/1982 | Barlow | 273/249 |
| 4,397,463 | 8/1983 | Moscovich | 273/1 GE |
| 4,569,522 | 2/1986 | Davies | 273/86 C |
| 4,602,789 | 7/1986 | Chung | 273/201 |
| 4,662,846 | 5/1987 | Quercetti | 434/96 |
| 4,743,024 | 5/1988 | Helm et al. | 273/143 R |
| 4,772,024 | 9/1988 | Werner | 273/144 B |
| 4,837,728 | 6/1989 | Barrie et al. | 364/412 |
| 4,892,311 | 1/1990 | Zaitsu | 273/145 D |
| 4,948,133 | 8/1990 | Helm et al. | 273/85 G |
| 4,964,638 | 10/1990 | Ishida | 273/138 A |
| 5,002,279 | 3/1991 | Kaminkow et al. | 273/119 A |
| 5,014,988 | 5/1991 | Mirando et al. | 273/125 A |

(List continued on next page.)

FOREIGN PATENT DOCUMENTS

| | | | |
|---|---|---|---|
| 1087361 | 10/1967 | United Kingdom | 273/138 A |

*Primary Examiner*—Paul E. Shapiro
*Attorney, Agent, or Firm*—Hickman Beyer & Weaver

[57] ABSTRACT

A redemption-type arcade game apparatus with a game token return. A token receiving mechanism on the game apparatus receives a game token or coin having a monetary value from a player. A game having a finite duration is started on the game apparatus in response to receiving the token. A desired goal can be achieved by a player during the game, such as guiding a playing piece into one or more apertures on a playing surface, or having the playing piece fall into a collector for a progressive bonus award. If the player achieves the desired goal during the duration of the game, an award dispenser dispenses a nonmonetary award to the player. When the desired goal is not achieved by the player during the duration of the game, a token having the same monetary value as the inserted token is returned to the player. The game apparatus also includes progressive features which provide an award to the player based on a progressive score if the player achieves a progressive goal.

21 Claims, 8 Drawing Sheets

U.S. PATENT DOCUMENTS

| | | | |
|---|---|---|---|
| 5,014,991 | 5/1991 | Mirando et al. | 273/138 A |
| 5,016,879 | 5/1991 | Parker et al. | 273/126 A |
| 5,016,880 | 5/1991 | Berge | 273/138 A |
| 5,024,441 | 6/1991 | Rousseau | 273/176 R |
| 5,042,810 | 8/1991 | Williams | 273/143 R X |
| 5,042,813 | 8/1991 | Huang | 273/182 R |
| 5,048,833 | 9/1991 | Lamie | 273/138 A |
| 5,096,192 | 3/1992 | Stanford, Jr. | 273/39 |
| 5,120,060 | 6/1992 | Parker et al. | 273/138 A |
| 5,137,278 | 8/1992 | Schilling et al. | 273/118 A |
| 5,149,093 | 9/1992 | Schilling et al. | 273/118 A |
| 5,181,722 | 1/1993 | Krutsch et al. | 273/127 B |
| 5,249,800 | 10/1993 | Hilgendorf et al. | 273/138 A |
| 5,275,402 | 1/1994 | Malavazos et al. | 273/454 X |
| 5,280,909 | 1/1994 | Tracy | 273/138 A |
| 5,286,023 | 2/1994 | Wood | 273/138 A |
| 5,292,127 | 3/1994 | Kelly et al. | 273/138 R |
| 5,397,134 | 3/1995 | Fishman | 273/448 |
| 5,511,794 | 4/1996 | Katamoto | 273/440 |

REDEMPTION-TYPE ARCADE GAME WITH GAME TOKEN RETURN

BACKGROUND OF THE INVENTION

1. Field of the Invention

This invention relates to games normally played in an arcade environment, and more particularly to redemption games which assure that a player is either given an award or the player receives back any token(s) or coin(s), or the value thereof, inserted to play the game.

2. Background of the Related Art

Games of many types are played in arcade environments. One type of game provides awards to players based on game performance.

An example of a game that awards a player can be found in U.S. Pat. No. 2,043,281, of P. T. Hart et al., which describes an award dispensing machine having roulette-type wheel. Prizes are dispensed to the player in response to skilled actions of the player.

Another example is found in U.S. Pat. No. 5,120,060, of Parker et al., which describes a casino game having guide pins and capture gates to direct a falling coin. A winning player receives the coins collected on a selected capture gate.

Yet another example is found in U.S. Pat. No. 4,743,024, of Helm et al., which describes a coin operated gaming machine in which random numbers of a displayed grid are illuminated according to a players inputs, and prizes are won if a winning combination is achieved.

The award-providing games of the prior art, while enjoyable, are limited to providing an award or payout to a player only when the player obtains a winning result when playing the game. These prior art games tend to discourage a player from continued use when a winning result is difficult or requires considerable experience to achieve. If a player is required to insert money for every game played in order to become experienced at the game, players may tend to quit playing the game. This drawback is undesirable in an arcade environment where revenues are directly related to the continuous, repeated use of the games. It is contemplated that an arcade game which guarantees that the player would either win an award or receive his money back would remain more interesting to players and generate greater revenues for the arcade owner.

SUMMARY OF INVENTION

The present invention provides a redemption-type arcade game with a game token return. A player either wins an award by achieving a goal during the game or receives his or her money back. This improvement allows players to play a game more often without risk of losing money required to play the game and receiving nothing in return.

A game apparatus of the present invention includes a token receiving mechanism for receiving a game token from a player. The game token has a monetary value, and can be, for example, a coin. A game having a finite duration is started on the game apparatus in response to receiving the token. A mechanism is included to allow a desired goal to be achieved by a player during the game. When a desired goal is not achieved by the player during the duration of the game, a mechanism may dispense a returned token to the player having the same monetary value as the game token that was inserted by the player. The returned token is preferably the game token that was inserted by the player. In the preferred embodiment, an award dispenser dispenses a non-monetary award to the player when the player achieves a desired goal during the duration of the game.

In a described embodiment of the present invention, the game apparatus includes an inclined playing surface for supporting a playing piece. The game token inserted by the player is preferably the playing piece of the game. The playing piece falls onto a guide mechanism which allows a player to influence the path of the playing piece on the playing surface. The guide mechanism is preferably a rotatable member with a controllable angular position to direct the playing piece in a desired direction. The playing piece moves down the inclined playing surface into a field of obstacles, such as upright-oriented pins, which deflect the playing piece when playing piece impacts the obstacles. A number of goal apertures are positioned in the playing surface such that a desired goal of the game is to have the playing piece fall into one of the apertures to receive an award. A preferred award dispensed by to the player includes redemption tickets. If a player does not achieve a desired goal during the game, the playing piece falls into a return which returns the game token to the player. In addition, a progressive bonus collector for receiving the playing piece and accumulating a progressive bonus score is positioned relative to the playing surface (this can be considered a different desired goal). To receive an award based on the progressive bonus score, a progressive goal is achieved. A preferred progressive goal is for every goal aperture to receive a playing piece. In another preferred embodiment, a progressive bonus apparatus is coupled to multiple individual game apparatus of the present invention. The progressive bonus apparatus accumulates a progressive apparatus score contributed to by the game apparatus coupled to it, and an award based on the progressive apparatus score can be won by a player of an individual game apparatus.

The preferred arcade game of the present invention guarantees that a player either achieves a desired goal during the game or receives his or her money back. The player preferably receives an award when he or she achieves a desired goal during the game. A player thus can play the game with no risk of losing money without winning an award. This can allow players to play the game multiple times, if desired, without concern for the cost of the game.

These and other advantages of the present invention will become apparent to those skilled in the art after reading the following descriptions and studying the various figures of the drawings.

DETAILED DESCRIPTION OF THE PREFERRED EMBODIMENTS

Figure 1:
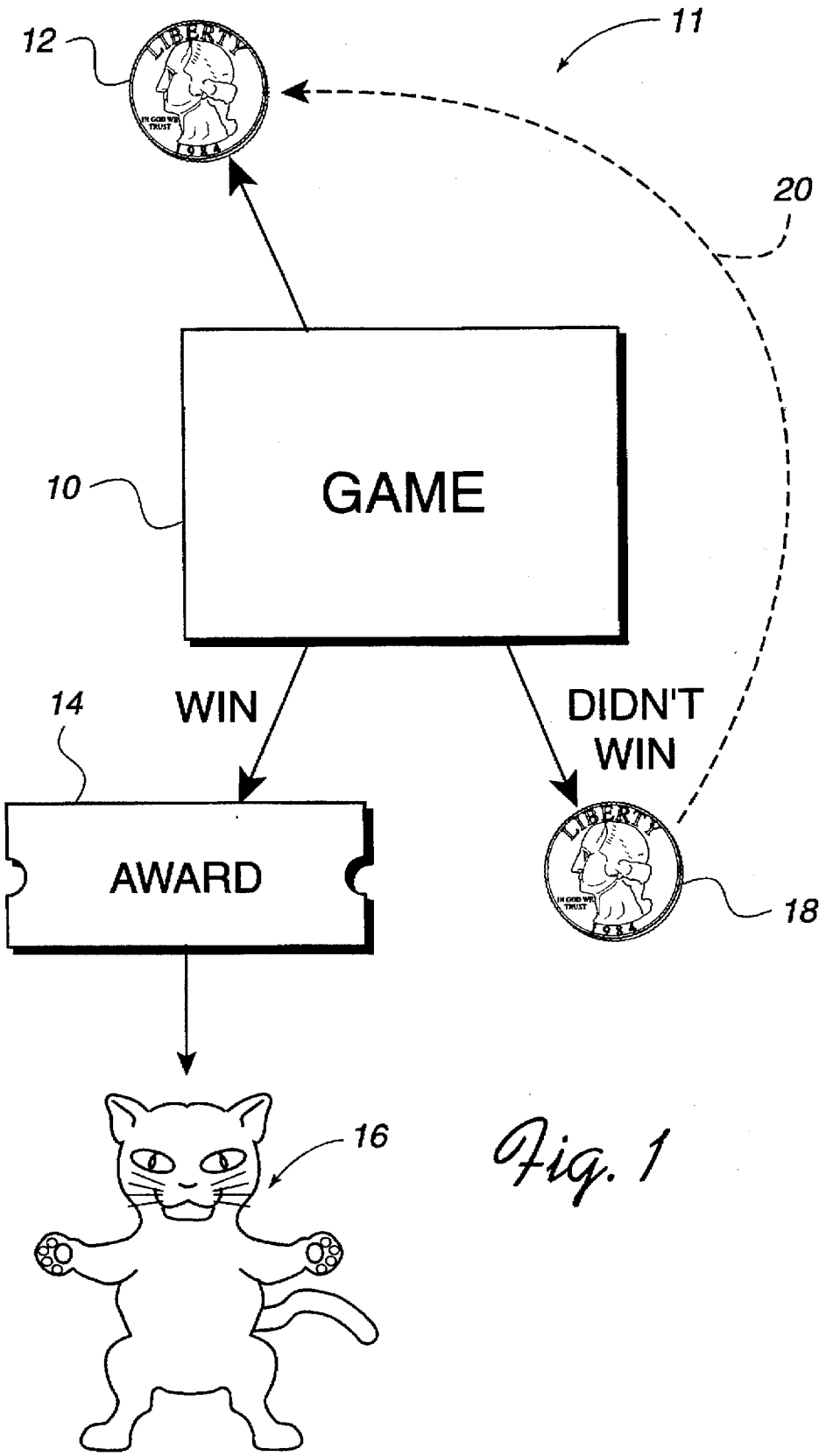
FIG. 1 is a diagrammatic illustration of a game apparatus and method of the present invention.

FIG. 1 is a diagrammatic illustration 11 of a game apparatus 10 and process that allows a player to either achieve a desired goal during the game or receive his or her money back in accordance with the present invention. This illustration presents the basic operation of the game apparatus.

A player inserts a token 12 into a coin slot or similar mechanism associated with the game apparatus 10 for receiving a token. This token can be a standard currency coin, a coin-shaped game token, or any similar object having a monetary value. Multiple tokens can also be received in some embodiments. The token is received by game apparatus 10 and causes a game to begin.

The game in progress has a finite duration. While the game is in progress, the player has at least one desired goal to achieve in order to "win" the game. That is, an objective is presented to the player that, when achieved, indicates that the player has won. There can be multiple desired goals for the player which, for example, increment a score by different amounts, provide awards of different values, etc. In the preferred embodiment, the player operates controls or performs other skilled actions which influence the outcome of the game to help him or her achieve a desired goal. For example, a player can move a joystick controller to manipulate game events, influence the path of a playing piece on a playing surface, stop a spinning dial, etc.

The game is over after one of several possible game events cause the game's duration to end. For example, a player can achieve a desired goal of the game, which can also end the game. Alternatively, a player can be given multiple opportunities to achieve a desired goal multiple times. A game can end when a predetermined time duration is reached after token 12 has been inserted. The player could have a specified length of time to achieve a desired goal. A game can also end if the player influences or causes a game event to end the game. For example, a player might mistakenly guide a playing piece to a target which automatically ends the game. Other variations and game events, or a combination thereof, can occur to end the game in progress.

Once the game is over, the player has either achieved a desired goal or has not achieved this goal. If a desired goal has been achieved, the game has been "won." In the preferred embodiment, the player is provided with an award 14 indicative of the goal achieved by the player. Such an award can be in many possible forms. One preferred non-monetary award includes redemption tickets which are redeemable for various prizes, such as prize 16. If a game score was accumulated during the game, the number of awarded tickets can be proportional to the game score. Alternatively, a predetermined amount of tickets can be awarded for every game. Other types of awards can also be provided to the player, such as sports or other types of trading cards, toy prizes in "egg" containers, etc.

If the player has not achieved a desired goal during the game, then the player did not "win", and a token 18 having the same monetary value as the token 12 is dispensed to the player. If multiple tokens 12 were inserted, the same number of tokens (or one or more tokens having the same monetary value) are dispensed back to the player. In the preferred embodiment, returned token 18 is the same token 12 which was inserted by the player into the game 10. In an alternate embodiment, token 18 can be a different token which has the same value as token 12. The player can re-insert token 18 back into game 10, as indicated by arrow 20, to play the game again. The player can thus continue to reinsert the same token until he or she achieves a desired goal and wins the game. There is thus a "no-lose" guarantee to players when playing game apparatus 10. This can help provide incentive to players to play a game if the players know they are not risking their money and that, eventually, they will likely win an award.

Figure 2:
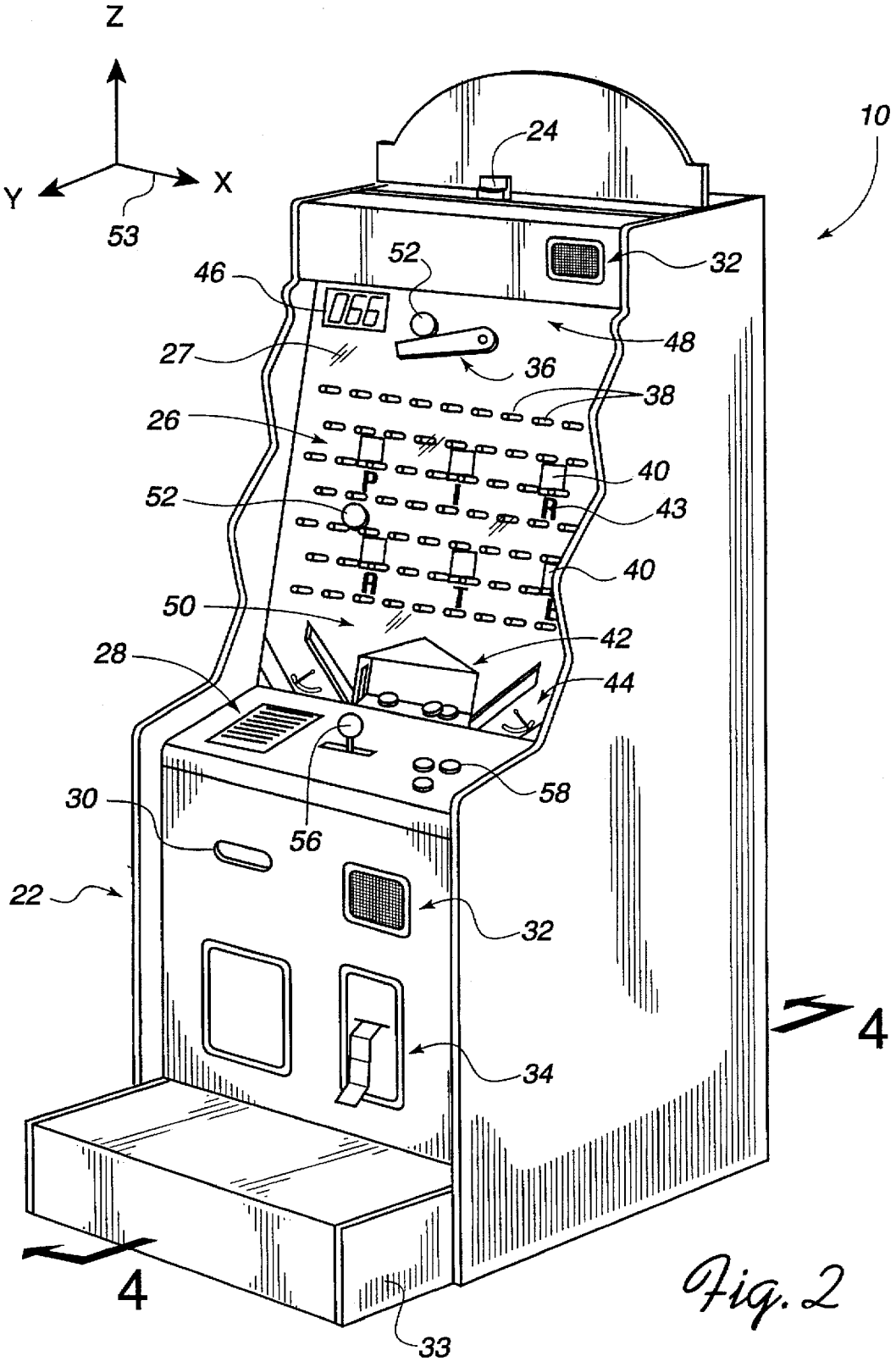
FIG. 2 is a perspective view of a preferred embodiment of the game apparatus described in FIG. 1.

FIG. 2 is a perspective view of a preferred embodiment of game apparatus 10 in accordance with the present invention of a redemption-type game with game token return. The game apparatus 10 includes a front panel section 22, a coin deposit slot 24, a playing surface 26, and player controls 28. In the description of this embodiment, the token inserted by the player is referred to as a "coin," which is also used as the playing piece in the game. Such a coin can be standard monetary currency, a coin-shaped game token which can be exchanged for money, or any other type of token having a monetary value.

Front panel section 22 includes a coin return slot 30, a speaker 32, and an award dispenser 34. A platform 33 is preferably included near the base of game apparatus 10 to allow players to reach coin slot 24 and insert a token or coin therein.

Coin return slot 30 provides the coin that the player inserted in coin slot 24 back to the player if the player does not score any points or achieve a goal during the game. A player can simply pick up the returned coin and insert it back into coin slot 24 if desired. Coin return slot 30 provides coins that have fallen into a return collector relative to playing surface 26, as described below.

The speaker 32 emits sounds based on game actions and other game states and is controlled by the game unit controller system. The operation of the speaker will be discussed in greater detail subsequently.

Award dispenser 34 preferably dispenses a ticket award to the player based upon the result of a game in progress. In this present embodiment, tickets may be accumulated and redeemed to win various prizes. Ticket dispensing mechanisms are well-known in the prior art. Other types of awards besides tickets may be dispensed by award dispenser 34. For example, sports cards or other trading cards or toy prizes can be dispensed. Coins or currency can also be dispensed as an award; more coins (or a higher monetary value) than were inserted by the player would be dispensed to that player as an award. The awards are stored in a storage area behind the front panel 22 which is described in more detail with reference to FIG. 4.

Coin deposit slot 24 preferably accepts standard currency coins or game tokens that are often available in an arcade environment. In the described embodiment, a coin deposited in coin deposit slot 24 becomes the playing piece for the game. Coin deposit slot 24 is thus positioned on the top side of the game apparatus 10 so that the coin can fall directly onto the playing surface 26. Alternately, coin deposit slot 24 may accept other types of objects suitable for use as playing pieces, or playing pieces can be released onto the playing surface in response to the deposit of a coin into slot 24. In alternate embodiments, slot 24 can also be implemented as an aperture receptive to other forms of playing pieces, such as cylinders, pyramids, cubes, or other shapes.

In embodiments where playing pieces other than coins or game tokens are used, the front panel 22 or other area of game apparatus 10 can include a playing piece dispenser. Such a dispenser, for example, can provide a playing piece to be inserted by the player into an aperture in the top of game apparatus 10 and includes a playing piece return apparatus which returns the playing piece to the playing piece dispenser after the game has been played. Such apparatus are well known to those skilled in the art. In such an embodiment, coin slot 24 accepts coins for immediate storage in a coin box and may be positioned in other areas of game apparatus 10, such as on front panel 22. A playing piece is preferably dispensed when a coin is inserted into the coin slot.

Playing surface 26 provides the game action, goals (objectives), and game results to the player of game apparatus 10. Surface 26 is preferably inclined such that a first end 48 of the surface is higher than a second end 50. A playing piece, such as a coin 52, can thus slide, roll, or otherwise move down the playing surface from the first end 48 to the second end 50 propelled by gravity. In the preferred embodiment, playing surface 26 has a transparent cover 27, such as plastic or glass, positioned about a half-inch above the playing surface 26 which prevents players from directly interfering with game action or mechanisms on the playing surface. Playing surface 26 includes a rotatable guide 36, obstacles 38, goal apertures 40, progressive bonus collector 42, return collector 44, and score display 46.

Rotatable guide 36 is preferably positioned near a first end 48 of playing surface 26 so as to receive a playing piece, such as coin 52, when the playing piece falls from coin deposit slot 24 onto playing surface 26. In the described embodiment, guide 36 can be controllably rotated around axis A by a player of game apparatus 10 using player controls 28 (described below). After coin 52 falls and is stopped by guide 36, the coin typically rolls down guide 36 as indicated by the angular position of the guide. The player can thus rotate guide 36 to a desired position to allow coin 52 to roll off the guide in a desired direction towards goal apertures 40 (described below). In alternate embodiments, rotatable guide 36 can be implemented using other mechanisms. For example, a funnel-type collector can be used and its horizontal position can be controlled by the player (on x-axis 53). The player can then control the release the coin from the collector to direct the coin in a desired area of playing surface 26.

Obstacles 38 are positioned on playing surface 26 to vary the path of coin 52 as the coin moves from the first end 48 to the second end 50 of playing surface 26. In the described embodiment, obstacles 38 are pins positioned such that they are projecting perpendicularly from playing surface 26. The pins are arranged in rows such that the pins of one row are offset horizontally (as defined by x-axis 53) from the pins in the rows immediately above and below that row. This allows coin 52 to collide with a pin on one row, move around the pin, and collide with a pin on the next row. Coin 52 thus impacts and bounces off pins in a somewhat random path down playing surface 26. Obstacles 26 are arranged in a pattern similar to well-known pachenko-style games in the described embodiment. A player can provide some influence to the path of the coin by guiding the coin to a certain section of playing surface 26 using rotatable guide 36. For example, if the player guides coin 52 to the left side of playing surface 26, then the coin will most likely bounce off obstacles on the left side and move down the left side of the playing surface.

In alternate embodiments, different and/or additional obstacles 38 can be positioned on playing surface 26. For example, ramps, ejection devices, depressions, cylinders, rotating spokes, etc. can be used to vary the path of coin 52 or other playing piece on playing surface 26.

Goal apertures 40 are preferably positioned amid the field of obstacles 38 on playing surface 26. The goal apertures are desired targets, and thus a desired goal, for coin 52, since the score is incremented and an award is given to the player when an goal aperture receives a playing piece. Goal apertures 40 are described in greater detail with reference to FIGS. 3, 4 and 5.

Progressive bonus collector 42 is preferably positioned near the second end 50 of playing surface 26. Collector 42 may collect coins that have moved through the field of obstacles 38 but have not fallen into a goal aperture 40. A player's game score is preferably increased when coin 52 falls into the progressive bonus collector. The progressive bonus collector is thus a desired goal for coin 52. In addition, a progressive bonus score equivalent to the amount of coins displayed by the progressive bonus collector can be added to the game score of the player if the player achieves a desired progressive goal during the game. When the desired progressive goal has been achieved, the displayed coins are preferably emptied out of the collector 42, as described in FIG. 3. The operation of progressive bonus collector 42 is described in greater detail with respect to FIG. 3.

Return collector 44 is preferably positioned near the second end 50 of playing surface 26. Return collector 44 collects a coin that has not fallen into a goal aperture 40 or progressive collector 42 and routes the coin back to coin return slot 30 so that it may be picked up by the player. The operation of return collector 44 is detailed with respect to FIGS. 3 and 4.

Return collector 44 is positioned such that a coin which does not score points for a player will be returned to that player. For example, a coin that falls into a goal aperture 40 or into progressive collector 42 causes points to be added to the game score. If the coin does not fall into one of these two targets, the only other target is the return collector 44. The player is thus guaranteed to either score points and win an award based on the points, or to receive his or her coin. If desired, the player can insert the received coin directly back into coin slot 24 until points are scored in the game. In the described embodiment, coin 52 that is returned to the player is the same coin inserted into coin slot 24. In alternate embodiments, coin 52 can fall into return collector 44 and a different coin or token, having the same value as coin 52, is dispensed to the player in coin return slot 30. The return coins can be stored in a storage box behind front panel 22 in such an embodiment.

Game score display 46 is positioned on playing surface 26 and provides the player of game apparatus 10 with the current game score. A number of awards, such as tickets, are preferably dispensed from award dispenser 34 based on the final game score. In other embodiments, game score display 46 can be positioned in other areas of game apparatus 10, such as on front panel 22 or on an upper surface of game apparatus 10.

Player controls 28 are used by the player to operate game apparatus 10. In the described embodiment, a joystick 56 can be moved by the player to rotate rotatable guide 36 in order to guide a coin or other playing piece in a desired direction. Preferably, the joystick can be moved left to rotate guide 36 in a clockwise direction, or the joystick can be moved right to rotate guide 36 in a counterclockwise direction. Mechanisms for moving mechanical parts in conjunction with a joystick are well known to those skilled in the art. Other controls can be used in other embodiments. For example, a dial can be rotated to correspondingly rotate guide 36, a button can be pushed, etc.

Buttons 58 can be used by the player of the game to make various selections concerning game play. For example, a player could select a one- or a two-player game, the preferred award type, a progressive option, etc.

The game score display, player control, coin detection, award dispensing, and other functions of the game apparatus are preferably controlled by a control system. This system is described in detail with respect to FIG. 6.

Figure 3:
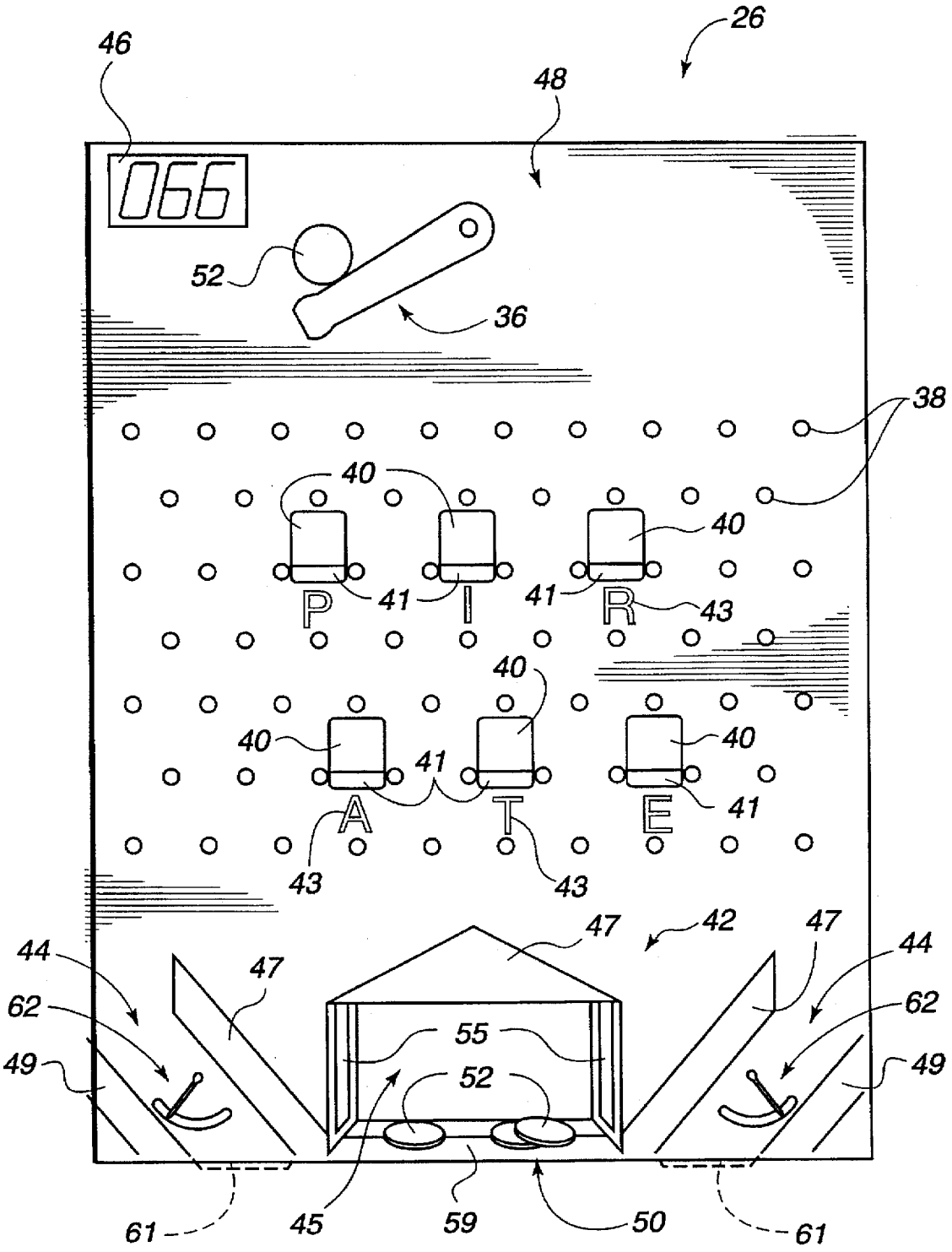
FIG. 3 is a front view of the playing surface of the game apparatus of FIG. 2.

FIG. 3 is a front view of playing surface 26 of game apparatus 10. A coin 52 emerges onto the first end 48 of playing surface 26 and drops onto rotatable guide 36. The coin is guided by rotatable guide 36 into the field of obstacles 38, which are preferably upright-oriented pins. The coin then follows a path determined by the pins that the coin collides into and bounces off.

The coin may follow a path leading it to a goal aperture 40. Each goal aperture includes a catch member 41 which is positioned at the bottom side of the aperture 40 to stop a coin which slides over the aperture and to guide the coin into the aperture. The coin then falls into a collector and is sensed by the control system, as described in greater detail with reference to FIG. 5.

When a coin falls into a goal aperture 40, a score shown on score display 46 is preferably increased by a predetermined amount. In addition, a designation or symbol associated with the aperture 40 which received the coin is preferably illuminated or highlighted. For example, in the described embodiment, a letter 43 is positioned below and is associated with each goal aperture 40. A letter is illuminated when a coin falls into the aperture 40 associated with the letter, and preferably stays illuminated until, for example, the progressive goal is achieved (described below) or the operator resets the game apparatus. If a player manages to guide coins into every goal aperture 40 so that the letters 43 for all apertures 40 are illuminated, the player has thus highlighted all the letters to spell, for example, the word "PIRATE" (or whatever word that is formed by all of the letters). This can be considered the desired progressive goal, and, for the player achieving this goal, a progressive bonus score equivalent to the amount of coins that have been accumulated in progressive bonus collector 42 is added to the game score (described below). Once a player achieves the progressive goal, all the illuminated letters 43 are preferably reset to a non-illuminated state. If a player does not achieve the progressive goal, all letters previously illuminated stay illuminated until a player achieves the progressive goal. Alternatively, all letters 43 can be reset to a non-illuminated state of the progressive goal is not achieved with a predetermined time limit or number of games. In other embodiments, alternate designs, symbols, etc. can be associated with goal apertures 40 and can be similarly illuminated or highlighted. Alternatively, a different predetermined pattern of goal apertures or other apertures can be illuminated to achieve the progressive goal. For example, a player might be required to illuminate three apertures and guide one coin into progressive bonus collector 42 to achieve the progressive goal.

Progressive bonus collector 42 is positioned near second end 50 of playing surface 26 and includes progressive guides 47 and progressive bonus receptacle 45. If coin 52 moves onto a progressive guide 47, the coin is guided into progressive receptacle 45 through a side aperture 55. The coins in receptacle 45 can be viewed by a player so that the player can determine how much would be added to his or her score if the progressive bonus goal was achieved. In the preferred embodiment, when a coin moves into receptacle 45, the game score is incremented, a progressive bonus score is incremented (described below), and the player receives an award such as tickets from dispenser 34. The control system preferably determines that a coin moved into the receptacle 45 when no coin is detected both in goal apertures 40 and in return collector 44. Alternatively, sensors similar to those described with reference to the goal apertures 40 or return collector 44 can be used to detect coins falling into progressive bonus collector 42.

Bonus receptacle 45 also includes a bottom door 59 which can be opened to allow any coins held by the receptacle to fall down into a coin box. This is described in greater detail with respect to FIG. 4. The control system causes door 59 to open when a player achieves the desired progressive goal, which, in the described embodiment, is accomplished when all letters 43 have been illuminated as described above. Door 59 can be periodically opened by the control system if no player has achieved the progressive goal so that coins will not overfill receptacle 45.

Return collector 44 receives any coins that have not fallen into a goal aperture 40 or progressive bonus collector 42. Return collector 44 preferably includes guides 49 which guide coin 52 into apertures 61 positioned at the second end 50 of playing surface 26. When a coin rolls down guide 49, return sensor 62 senses the presence of the coin. In the described embodiment, return sensor 62 is a switch that is pivoted when the coin rolls into the switch. In alternate embodiments, return sensor 62 can be implemented with other mechanisms, for example, an electromagnetic emitter/detector, a magnetic sensor, etc. When return sensor 62 detects a coin, a signal is sent to inform the control system that a coin has been returned to the player.

Figure 4:
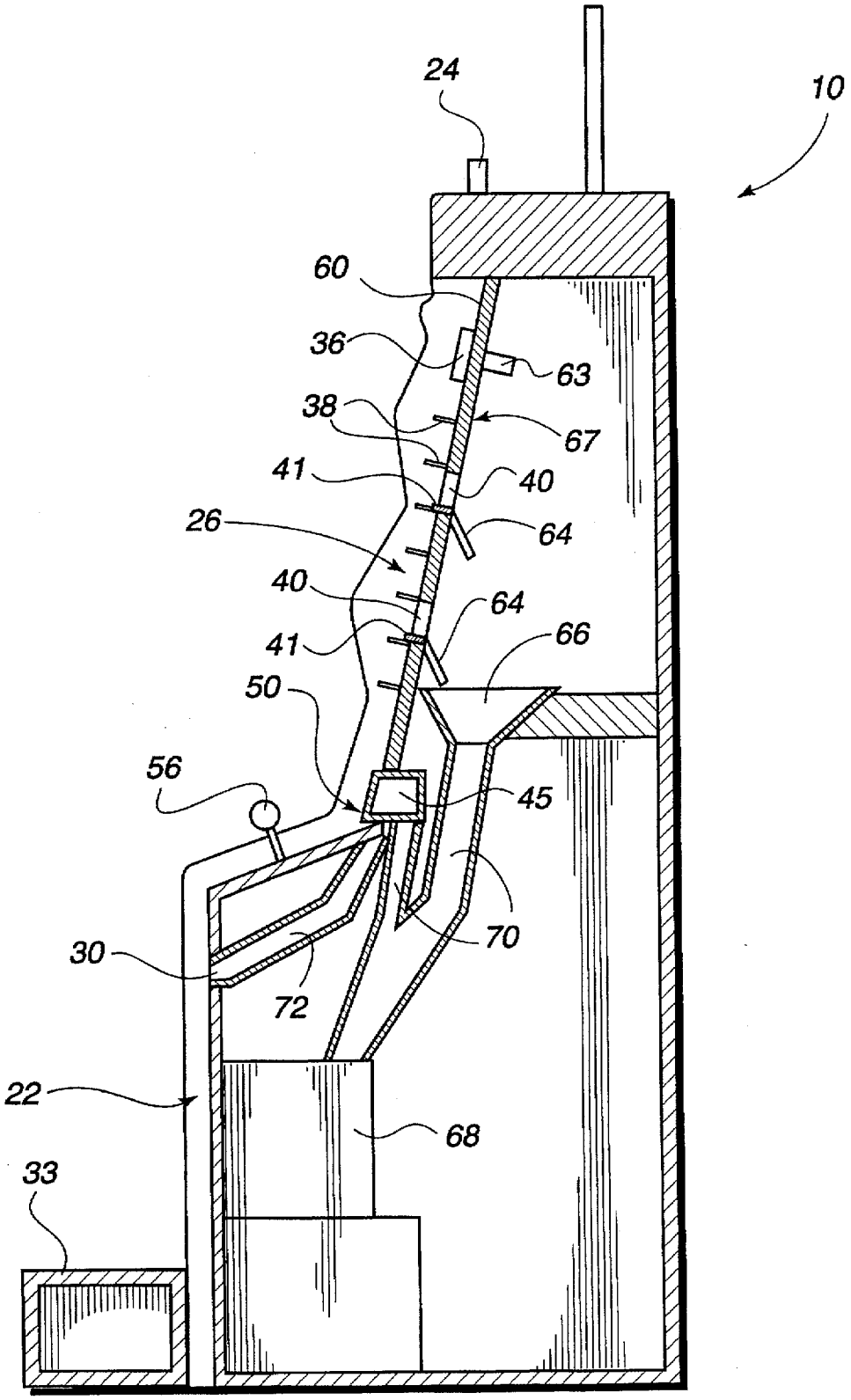
FIG. 4 is a side cross-sectional view taken along line 4—4 of FIG. 2.

FIG. 4 is a cross sectional side view of game apparatus 10 taken along line 4—4 of FIG. 2. Playing surface 26 is preferably the front surface of a planar member 60 which has been inclined a few degrees from a vertical orientation. Rotatable guide 36 is rotated by motor 63 positioned on the opposite (back) side 67 of planar member 60. Motor 63 is electrically coupled to the control system and joystick 56 by well-known methods.

Goal apertures 40 extend through the thickness of planar member 60. A thin back plate (not shown) or a small thickness of planar member 60 is preferably positioned at the back side of planar member 60 at each aperture 40 to prevent a coin from falling all the way through planar member 60 and to help guide the coin into a coin detector 64. A coin detector 64 preferably extends from each coin stop 41 and receives a coin after the coin has fallen into an aperture 40 or been stopped by stop 41. The coin detector detects the presence of the coin and sends a signal to the control system when a coin has been detected. The detection of a coin is described in greater detail with respect to FIG. 5. Coin detectors 64 also direct a coin from aperture 40 to a main collection funnel 66. A coin preferably falls from a coin detector 64 into the collection funnel 66 and is then directed into a coin box 68 by a coin chute 70. In an alternate embodiment, coins which fall into goal apertures 40 can be routed to fall into bonus receptacle 45.

Coins which fall into bonus receptacle 45 are accumulated in receptacle 45 until a player achieves the progressive goal. At that point, a progressive bonus score in accordance with the amount of coins that have fallen into receptacle 45 is added to the player's game score. The control system knows the amount of coins in the receptacle by sensing the coins that have fallen into goal apertures 40 and return collector 44 (all other coins are thus in receptacle 45). Once the progressive goal has been achieved, the coins in receptacle 45 can be directed into coin box 68. Bottom door 59 of receptacle 45 (shown in FIG. 3) is opened by the control system, which causes all the coins in receptacle 45 to fall into chute 70 and into coin box 68. Coin box 68 is preferably positioned behind the front panel section 22. An operator may access the coins collected in coin box 68 through the front panel 22 or from the rear of game apparatus 10.

Coins which fall into return collector 44 preferably fall into aperture 61 at the second end 50 of playing surface 26 (see FIG. 3) and into a return chute 72 located beneath planar member 60. Chute 72 routes the coin back to coin return slot 30 where the coin is accessible to the player.

Figure 5:
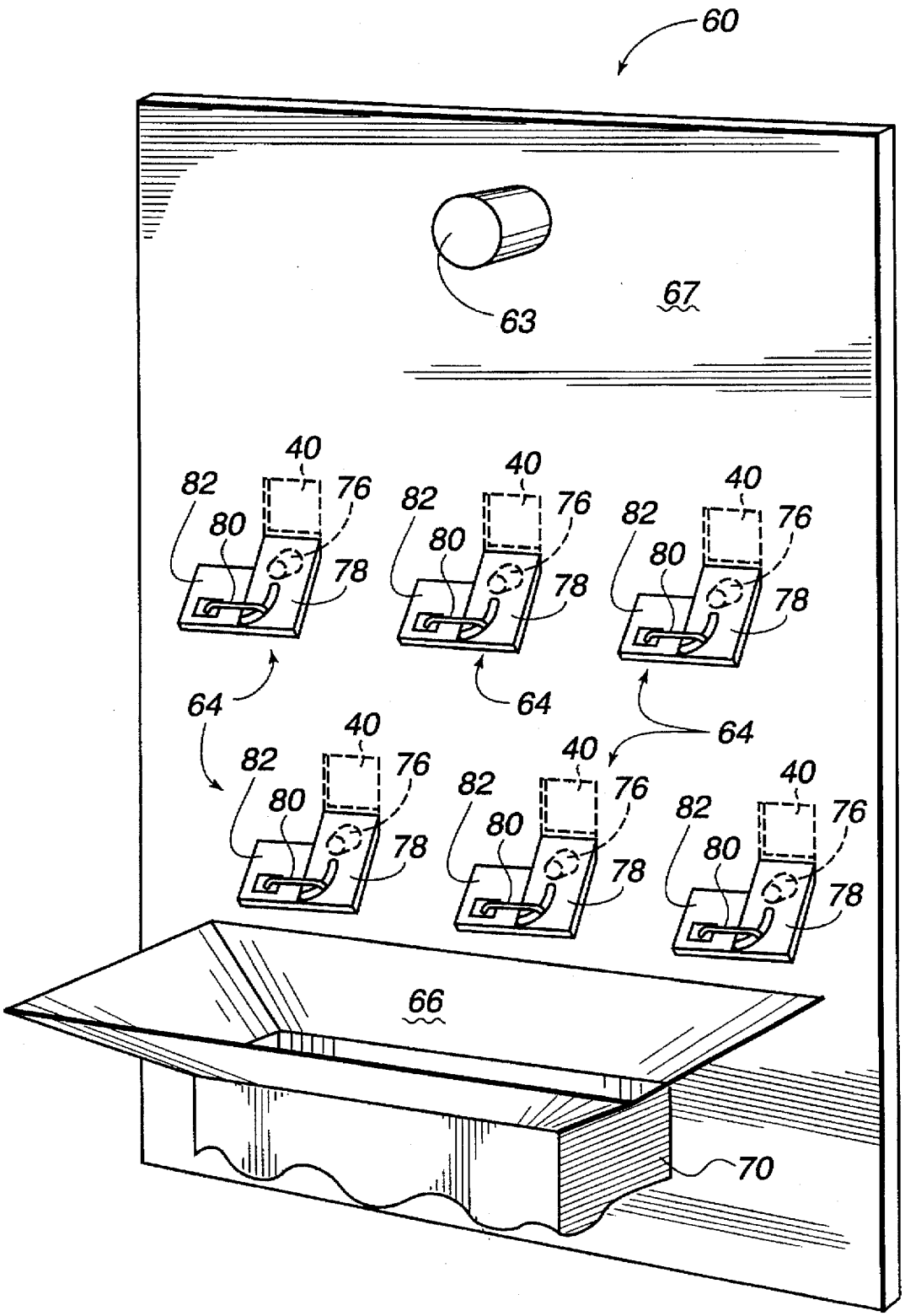
FIG. 5 is a perspective view of back side of the playing surface shown in FIG. 3.

FIG. 5 is a perspective view of the back side 67 of planar member 60. Motor 63 is used to rotate rotatable guide 36 positioned on the front side of planar member 60, as described with reference to FIG. 3. Light sources 76 are positioned on the back side 67 of planar member 60 under coin detectors 64. The light sources illuminate the letters 43 displayed on the playing surface 26 of planar member 60 through transparent or translucent material and are controlled by the control system (detailed with respect to FIG. 6).

Coin detectors 64 are positioned on the back side of planar member 60, each detector aligned with an aperture 40. A coin falls into aperture 40 or is stopped by coin stop 41 on the front playing surface 26. The coin then passes through a detector 64, which directs the coin to fall into collection funnel 66 below. Each coin detector 64 preferably includes a tube 78, a switch 80, and a switch support 82. Tube 78 receives and directs the coin toward funnel 66. Switch 80 is pivotally attached to switch support 82. When a coin falls through tube 78, the coin pushes switch 80 causing a signal to be sent to the control system which indicates a coin has been detected.

Figure 6:
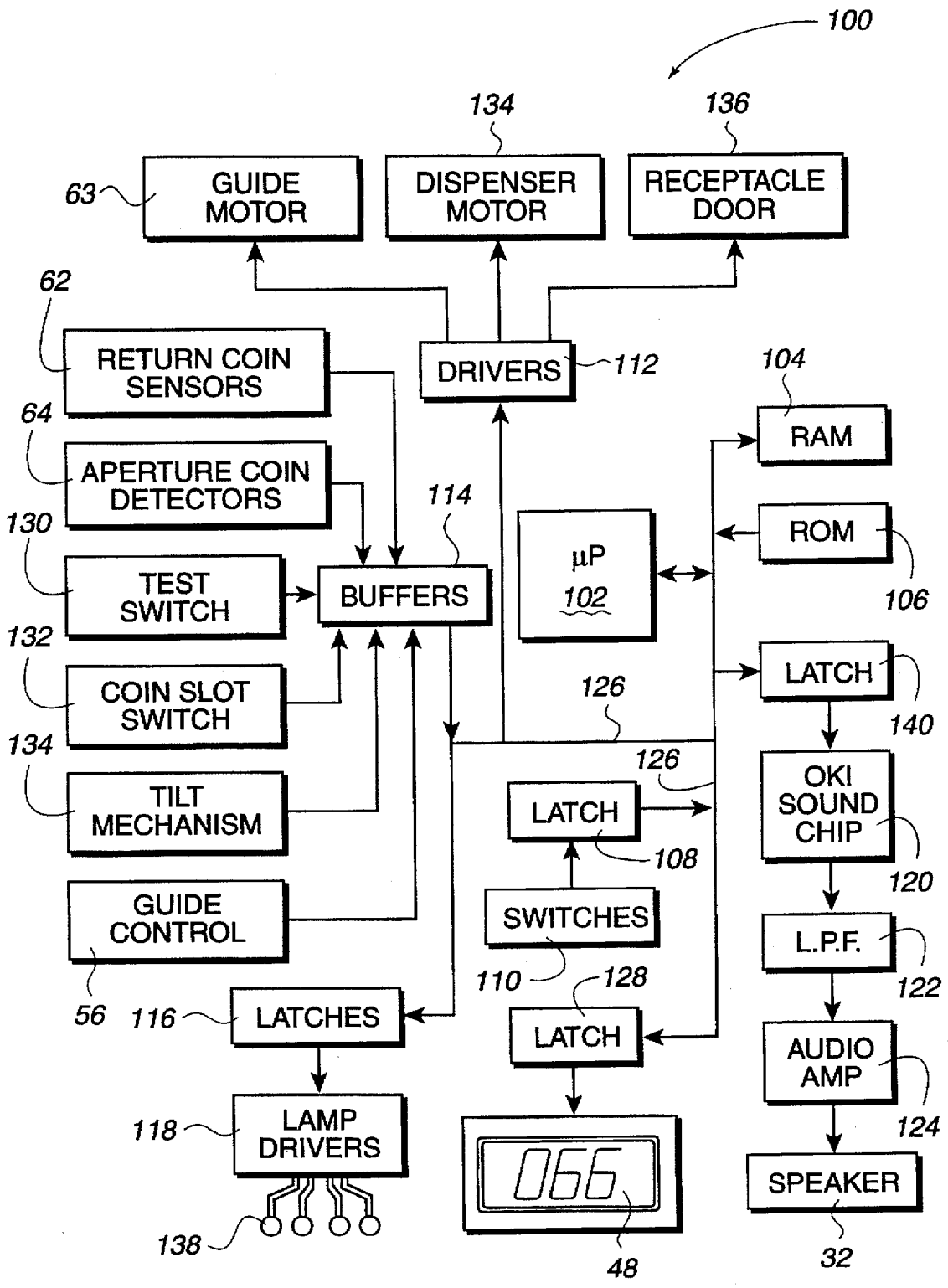
FIG. 6 is a block diagram of a control system used in the game apparatus of FIG. 2.

FIG. 6 is a block diagram of a control system 100 of game apparatus 10. The control system, for example, can be implemented on one or more printed circuit boards which can be located in the interior of game apparatus 10, for example, on a side in the interior of the game apparatus. The components of control system 100 include a microprocessor 102, random access memory (RAM) 104, read-only memory (ROM) 106, a latch 108, DIP switches 110, a game score display 46, drivers 112, buffers 114, latches 116, lamp drivers 118, sound chip 120, low pass filter 122, audio amplifier 124, and speaker 32.

The microprocessor 102 is preferably an 8-bit microprocessor, such as the Intel 8031, which has the range of features adequate for the task, including eight data lines and sixteen address lines. Microprocessor 102 is coupled to ROM 106 by a data/address/control bus 126. The ROM 106 is preferably an erasable, programmable read-only memory (EPROM) that contains the start-up instructions and operating system for the microprocessor 102. Microprocessor 102 is connected to RAM 104 by bus 126 to permit the use of RAM for scratch-pad memory. Methods for coupling ROM 106 and RAM 104 to the microprocessor 102 by bus 126 including enable, address, and control lines are well-known to those skilled in the art.

The microprocessor 102 is also coupled to a latch 108 by the bus 126. The switches 110 coupled to latch 108 provide selectable functions that the operator of the game unit may change to his or her liking. These selectable functions include the amount the score is incremented when a coin falls into a goal aperture or the progressive bonus collector, the amount of tickets dispensed based on the score, the conditions required for a player to win the progressive bonus, etc. These factors can affect the difficulty of the game and the size of the award received by players. Other functions selectable by switches 110 include sound effects, the test mode, the type of game, and so on, depending on how many selectable functions are desired. Switches 110 can, for example, be implemented as DIP switches. Alternatively, the functions selected by switches 110 can be selected from another input device, such as a control panel of buttons, or through software commands to the microprocessor 102.

The microprocessor 102 is also coupled to game score display 46. The bus 126 connecting the microprocessor 102 to the score display 46 is latched by a latch 128. The game score display can be a 7-segment LED digit display or similar display.

The microprocessor 102 is also coupled to drivers 112 and buffers 114. Buffers 114 receive data from several switches and sensors, including test switch 130, coin slot switch 132, tilt mechanism 134, guide controller 56, aperture coin detectors 64, and return coin sensors 62. Test switch 130 can be a switch located in the interior of game apparatus 10 accessible to the operator which activates a test mode for the game apparatus 10 to determine if the game is operating correctly. Coin slot switch 132 detects when a coin has been inserted into coin slot 24 of the game apparatus. Tilt mechanism 134 detects if the game apparatus 10 has been tilted too far to one side by a player, and is well known to those skilled in the art. Guide controller 56, which is a joystick in the described embodiment, sends control signals to the microprocessor to move rotatable guide 36. Aperture coin detectors 64 detect the presence of coins that have fallen into apertures 40, as described above. Return coin sensors 62 detect the presence of a coin that has fallen into return collector 44, as described above.

Drivers 112 activate and drive output devices including guide motor 63 for rotating rotatable guide 36, dispenser motor 134 for dispensing an award from dispenser 34, and receptacle door mechanism 136, which opens bottom door 59 of the bonus receptacle 45 using a solenoid, motor, or similar device, as is well known to those skilled in the art.

The microprocessor 102 is also coupled to latches 116 which latch data for the lamp drivers 118. The lamp drivers 118 supply power to the lamps 138, which include light sources 76 for illuminating letters 43 on playing surface 26 as well as additional lamps provided around the perimeter of playing surface 26, front panel 12, and other similar areas of game apparatus 10 which can be highlighted as part of game action. In the preferred embodiment, components such as the motors 63 and 134 and lamps 122 are powered by a commercially available 110 V AC power supply and power converters, which are well known in the art.

The microprocessor 102 is also coupled to a sound chip 120 which can be, for example, an OKI Voice Synthesis LSI chip available from OKI Semiconductor of San Jose, Calif. that has eight data input lines coupled to the microprocessor 102 by a latch 140. The sound chip 120 can receive its data from ROMs (not shown) and preferably outputs sound data to a low pass filter 122, an audio power amplifier 124, and finally to the output speaker(s) 32, which generate sounds to the player playing the game apparatus 10, as is well known to those skilled in the art.

The preferred embodiment of the control system 100 operates briefly as follows. The microprocessor 102 first reads the low memory from ROM 106 over bus 126 and sequences through the software instructions stored in ROM. The settings of DIP switches in the switches block 110 are also read into the microprocessor. The software from the ROM 106 then instructs the microprocessor 102 to send and receive data over the bus 126 in order to conduct a game. For example, when the coin slot switch 132 is activated, indicating a coin has been inserted into coin slot 24, the microprocessor receives a signal from the buffers 114 on bus 126. The microprocessor also receives a signal when joystick controller 56 is moved by the player. The microprocessor sends signals to the drivers 112 over bus 126 to control rotatable guide 36 as appropriate to game action. The microprocessor reads buffers 114 to determine if aperture coin detectors 64 and return coin sensors 62 have sensed any coins failing into apertures 40 or return collector 44. During game play, the microprocessor sends appropriate output signals over bus 126 to update game score display 46 and activate speaker 18 and lamps 204 whenever game action occurs, such as when a coin in inserted and when a coin is detected. Once the game is over, the microprocessor activates dispenser motor 134 and awaits another signal from coin slot switch 132 indicating another coin has been deposited in coin slot 24. The method of operation of the preferred embodiment of the game apparatus is described in greater detail with respect to FIG. 7.

Figure 7:
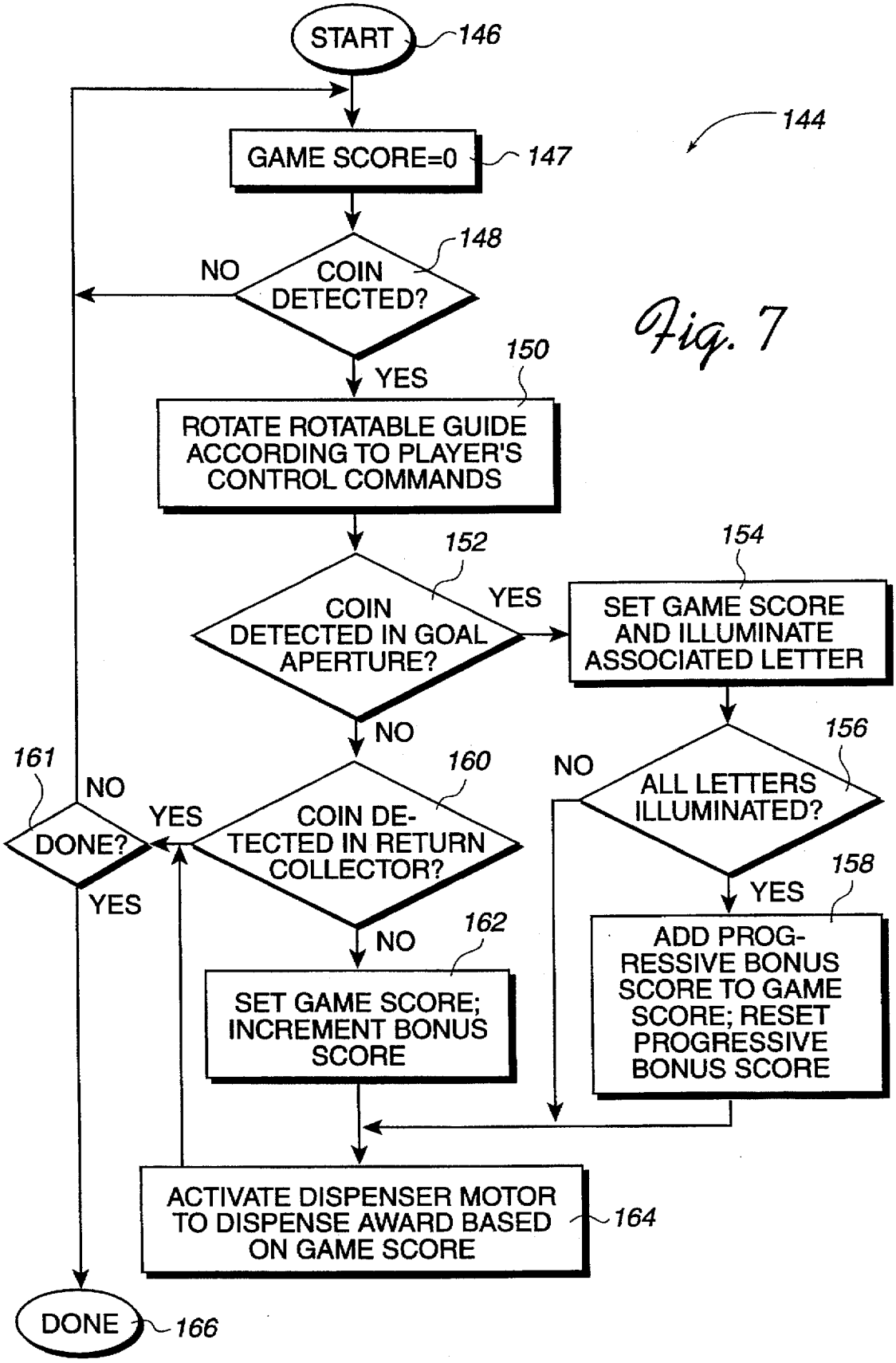
FIG. 7 is a flow diagram illustrating the method of playing and operating the game apparatus of FIG. 2.

FIG. 7 is a flow diagram illustrating a method 144 of operating and playing game apparatus 10. The process begins at 146. In step 147, the game score is set to zero. In step 148, the microprocessor checks if a coin has been inserted into coin slot 24 by checking a signal from coin slot switch 132. If no coin is detected, step 148 is repeated until a coin is detected. In step 150, the microprocessor rotates rotatable guide 36 in accordance with the player's commands input with controller 56. The guide 36 can be preferably rotated by the microprocessor at any time in response to controller 56 being activated by a player, even during the remaining steps of the method 144 or before a coin is detected in step 148.

In step 152, the microprocessor checks if a coin has been detected in a detector 64 for a goal aperture 40. If not, then the process continues to step 160, detailed below. If so, then, in step 154, the microprocessor sets the game score to a predetermined number, such as 20. The game score display 46 is updated to display the current score. The microprocessor also controls the light source 76 for the aperture 40 which received the coin to illuminate the letter 43 on playing surface 26 associated with that aperture. In step 156, the microprocessor checks if all letters 43 on playing surface 26 are now illuminated, which indicates that at least one coin has fallen into all goal apertures 40 since the last progressive goal was achieved by a player. If all letters 43 are not illuminated, the process continues to step 164, detailed below. If all letters 43 are illuminated, then step 158 is implemented, in which the microprocessor adds the progressive bonus score to the current game score; this sum is considered the new "game score." The progressive bonus score is determined by the amount of coins that have fallen into progressive bonus collector 42 and which are displayed in receptacle 45. The microprocessor has the progressive score amount stored in memory, such as RAM 104. Each coin in receptacle 45 can be worth the same amount of score points as a coin that fails into an aperture 40; for example, each coin collected by bonus collector 42 can be worth 20 points when the progressive goal is achieved. Thus, if 10 coins have been collected in receptacle 45, the total progressive bonus score is equal to 200, which is added to the game score. Once the progressive bonus score has been added to the game score, the progressive bonus score is reset to zero in memory and the coins displayed in receptacle 45 are released into coin box 68. The process then dispenses an award the player in step 164, as described below.

If a coin is not detected in any of the goal apertures 40 in step 152, then step 160 is implemented, in which the microprocessor checks if a coin has been detected in the return collector 44 by a return coin sensor 62. If so, then the coin has been returned to the player and the game is over. In next step 161, the microprocessor checks if the game process is complete, which can occur, for example, when the operator deactivates the game apparatus, the coin box is full and must be emptied, etc. If so, the process ends at 166. If the game process is not complete, step 147 is again implemented and the game waits for another coin to be inserted in step 148.

If a coin is not detected in the return collector in step 160, then it can be assumed that the coin has fallen into the progressive bonus collector 42. Step 162 is then implemented, in which the microprocessor sets the game score to a predetermined amount. Preferably, the score for a coin falling into the progressive bonus collector is less than the score for the coin failing into an award aperture 40. For example, a game score of 10 can be set for a coin falling into bonus collector 42. The collected coin is displayed in receptacle 45. The microprocessor also increments the progressive bonus score (stored in memory) in step 162 by a predetermined amount, such as 20 points. Alternatively, the progressive bonus score can be calculated when the player wins the progressive bonus award in step 158 by multiplying the known number of coins in receptacle 45 by a factor, such as 20.

In next step 164, the microprocessor activates the dispenser motor 134 of award dispenser 34 to provide the player with an award based on the game score (the game score may or may not include the progressive bonus score, depending on if the player achieved the progressive goal or not). For example, one award ticket can be dispensed for each point of game score. Alternatively, one award ticket can be dispensed for every X scored points; for example, X=10. In next step 161, the microprocessor checks if the process is complete, which can occur if the operator wishes to deactivate the game, the award dispenser needs to be refilled, etc. If so, the process ends at 166. If not, the process returns to step 147.

Figure 8:
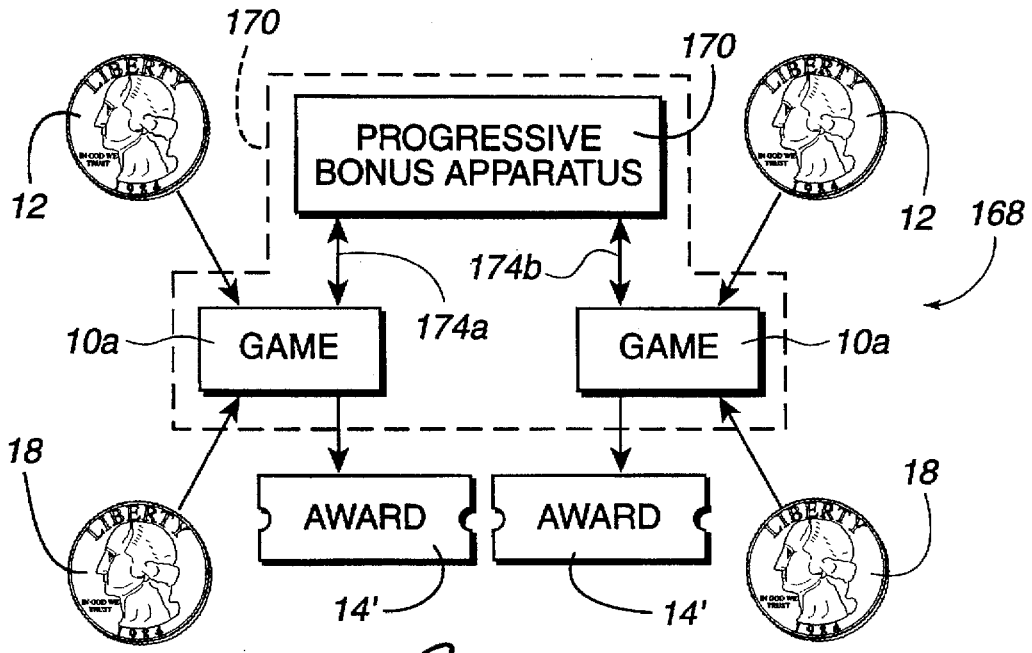
FIG. 8 is a block diagram of a multi-station game apparatus in accordance with the present invention.

FIG. 8 is a block diagram illustrating a process 168 that a multi-station game apparatus 170 uses to receive tokens and dispense awards with a progressive bonus apparatus in accordance with the present invention. The progressive bonus apparatus described in FIGS. 8 and 9 displays a progressive apparatus score to a player which is separate and additional to any individual progressive score accumulated by progressive bonus collector 42 of each individual game apparatus.

Multi-station game apparatus 170 includes a progressive bonus apparatus 172 coupled to a first individual game apparatus **10*a* and a second individual game apparatus 10*b*. Further individual game apparatus 10 may be coupled to the progressive game apparatus 172 as desired. The progressive bonus apparatus preferably is positioned exterior to the game apparatus 10*a* and 10*b***, and includes a progressive score display viewable by all players of the game apparatus.

Each individual game apparatus 10 has the ability to be played on its own as described in FIGS. 1–7 above, independent of other game apparatus 10 coupled to progressive bonus apparatus 172. In an alternate embodiment, a single individual game apparatus 10 is coupled to progressive bonus apparatus 172, which can be positioned within the single individual game apparatus 10. In another alternate embodiment, a smaller progressive bonus apparatus 172 is placed above or on top of a single individual game apparatus.

A player inserts one or more tokens 12 or other monetary input into an individual game unit 10*a* and 10*b*. Each game unit 10*a* and 10*b* is connected to the progressive bonus apparatus 172 by a data bus 174*a* and 174*b*, respectively.

The progressive bonus apparatus 172 shows a progressive apparatus score on a score display (see FIG. 9) which starts at a predetermined value. For example, the progressive apparatus score might be set at a starting score of zero. Or, so that a bonus award might be immediately available to players, the starting score could be set at a higher value.

The progressive apparatus score is preferably accumulated from contributions by the individual game apparatus 10*a* and 10*b* over the data busses 174*a* and 174*b*. The contributions can be determined in a variety of ways. In the preferred embodiment, each game apparatus 10*a* and 10*b* sends a signal to the progressive bonus apparatus 172 whenever a player deposits a coin into coin slot 24 of a game apparatus 10*a* or 10*b*. When the progressive bonus apparatus 172 receives this signal, it increments the progressive apparatus score by one, one-half, or another predetermined value. Thus, each game apparatus 10*a* and 10*b* that is played will increment the progressive apparatus score by this value. Other methods might be used where the game apparatus 10 sends its increment signal when a player reaches a predetermined score or achieves a goal. Also, the progressive bonus apparatus 172 could be set to multiply the progressive apparatus score by a selected quantity whenever an individual game apparatus 10 sends an increment signal.

Each individual game apparatus 10*a* and 10*b* has one or more progressive apparatus goals for the player to accomplish in order for the player to receive a bonus award 14' based on the progressive apparatus score. All game apparatus 10 that are attached to a single progressive bonus apparatus 172 preferably require the same progressive apparatus goal, so that each player competing for the progressive apparatus score has a goal of the same duration and level of difficulty. The progressive apparatus goal has several possible variations. In the embodiment described above, the progressive apparatus goal can be the same as the individual progressive goal of each game unit, i.e., a player must illuminate all letters 43 displayed on playing surface 26 of a game apparatus 10. Thus, when a player achieves the progressive goal by illuminating the final letter 43, that player would win an award based on the score of the coin falling into the goal aperture of that letter, plus the progressive bonus score from the individual game apparatus 10 as indicated in receptacle 45 of that game apparatus, plus the progressive apparatus score indicated by the progressive bonus apparatus 172. In other embodiments, a player might have additional or different progressive apparatus goals to achieve during a game, such as achieving a high score, illluminating a certain pattern of letters 43 or other symbols, etc. In still other embodiments, the progressive apparatus goal can be a separate goal from the progressive goal of each individual game apparatus. For example, the individual progressive goal could be to illuminate all letters 43, while the progressive apparatus score could be to score a predetermined number of points.

The first player to accomplish the progressive apparatus goal is entitled to a bonus award 14' based on the progressive apparatus score. The bonus award can be tickets, prizes, etc., as described above. The bonus apparatus 172 can send the progressive apparatus score data over data bus 174 to the winning game apparatus 10*a* or 10*b*. The winning game apparatus 10*a* or 10*b* can then dispense the bonus award 14' to the player by that game apparatus's award-dispenser 34. The progressive apparatus score of apparatus 172 is then reset to its beginning state. Alternatively, the bonus award 14' can be given manually to the winning player by the owner or operator of the multi-station game apparatus 170. If a player does not accomplish any desired goals during a game (progressive or otherwise), the player receives back an equivalent token 18 as described above with reference to FIG. 1.

Figure 9:
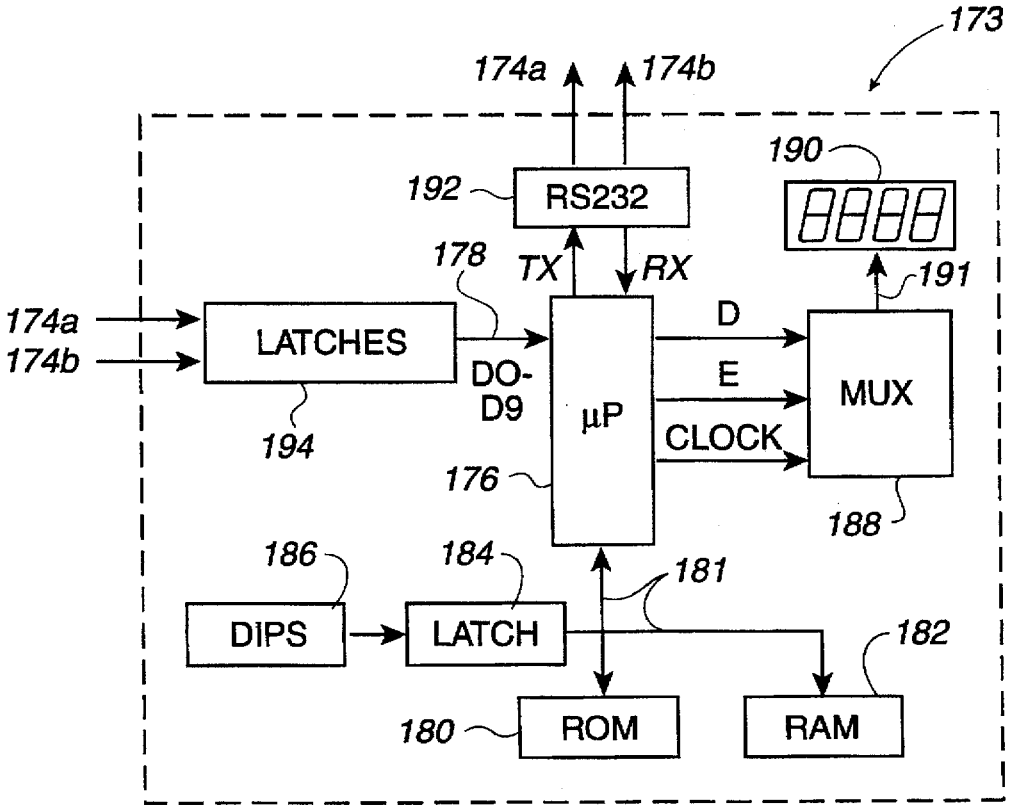
FIG. 9 is a block diagram of a control system for a progressive bonus apparatus used in the multi-station game apparatus of FIG. 8.

FIG. 9 is a block diagram of a control system 173 for the progressive bonus apparatus 172. The control system 173 includes a microprocessor 176, data bus 178, read-only memory (ROM) 180, random-access memory (RAM) 182, a latch 184, DIP switches 186, a multiplexer 188, an LED display 190, and an RS-232 port 192.

The microprocessor 176 is preferably an 8-bit microprocessor, such as the Intel 8031 as described above in FIG. 6. The microprocessor 176 receives data inputs D0–D9 inputs on data bus 178 from individual game apparatus that are connected to the progressive bonus apparatus 172; one data line is required per game apparatus, so ten individual games may be connected to the progressive bonus apparatus in this embodiment. Data latches 194 are used to couple the data busses from each unit (such as data busses 174*a* and 174*b*) to the data bus 178.

The microprocessor 176 is coupled to ROM 180 by an address/control/data bus 181. The ROM 180 is preferably an erasable programmable read-only memory (EPROM) that contains the start-up instructions and operating system for the progressive bonus apparatus. Microprocessor 176 is connected to RAM 182 by the bus 181 to permit the use of RAM as scratch-pad memory.

The microprocessor 176 is also coupled to a latch 184 and DIP switches 186 by bus 181. The DIP switches 186 provide selectable functions that the owner or operator of the progressive bonus apparatus 172 may change to his or her liking. These selectable functions include setting the base payout score that the progressive bonus apparatus 172 will display in its starting state, and the increment value that the apparatus will use to increase the progressive score whenever a player achieves the progressive apparatus goal Other selectable functions could also be set by the DIP switches depending on how many selectable game options and features are desired.

The microprocessor 176 is also coupled to a multiplexer 188. The multiplexer 188 receives a clock signal, an enable signal, and a serial LED data signal from the microprocessor 176. The multiplexer then outputs control signals to the segments of the LED display 190 on a bus 191 to display the progressive apparatus score.

The progressive bonus apparatus can also send and receive message signals through a standard RS-232 interface 192. Other interface standards, such as RS-485, can also be used. The RS-232 interface allows the control system 173 to send signals to individual game apparatus 10*a* and 10*b* over busses 174*a* and 174*b*, respectively. The RS-232 port can also be coupled to a computer system or other data processing system to allow the control and analysis of the control system 173.

The control system 173 for the progressive bonus apparatus 174 operates as follows. The microprocessor 176 sequences through the software instructions stored in ROM and then reads the DIP switches 186, reads the game apparatus signals on busses 174*a* and 174*b* from the latches 194, and displays or updates the score LED display 190 with the information from the game apparatus signals. If a game apparatus signal on busses 174*a* or 174*b* indicates a token has been inserted in an individual game apparatus 10*a* and 10*b*, the microprocessor increments the progressive score. When a game apparatus signal on busses 174*a* or 174*b* indicates that a progressive goal has been achieved on a game apparatus 10*a* or 10*b*, microprocessor 176 sends signals to, for example, flash the apparatus score display 190 and activate lights and sound speakers (not shown) indicating the bonus has been won. A bonus award based on the combined score from the individual game apparatus 10*a* or 10*b* and the progressive bonus apparatus is then given to the player who won, preferably using the dispenser 34 of the winning game apparatus 10*a* or 10*b*.

While this invention has been described in terms of several embodiments, it is contemplated that alterations, modifications and permutations thereof will become apparent to those skilled in the art upon a reading of the specification and study of the drawings. For example, many other types of games can be implemented which use the concept of a player either winning the game or receiving his or her money back. In games which provide the player with an award, the player can be guaranteed to either receive an award or get his or her money refunded depending on the player's performance in the game and if a certain goal was accomplished. Various goals can be attempted by the player in a game, such as hitting a specific target with a playing piece, achieving a certain score, accomplishing a task or solving a puzzle within a time limit, etc., to win an award. It is therefore intended that the following claims include all such alterations, modifications and permutations as fall within the spirit and scope of the present invention.

What is claimed is:

1. A guaranteed award dispensing game apparatus comprising:

a token receiving mechanism for receiving one or more game tokens from a player, wherein each of said game tokens has a monetary value, and wherein a game is started on said game apparatus in response to receiving one or more of said game tokens;

a non-horizontal playing surface for supporting one or more of said game tokens during said game, wherein said non-horizontal playing surface includes at least one aperture for receiving said game token;.

a guide operative to allow ode or more desired goals to be achieved during said game, where said desired goals may or may not be achieved and wherein at least one of said desired goals is achieved based on a path of said game tokens on a playing surface, said guide being movably arranged within said game apparatus so as to influence the movement of said game tokens on said playing surface, said guide being controllably positioned by said player, wherein said guide includes a rotatable member having an angular position, wherein said angular position of said rotable member can be controlled by said player to guide said game tokens in desired directions across said playing surface;

a bonus collector for collecting a plurality of said game tokens from said playing surface, said bonus collector being operative to receive said game tokens that do not have a path achieving at least one of said desired goals and that engage said collector, and to deliver a bonus award to said player that is proportional to said collected tokens when a predetermined plurality of said desired goals have been achieved, said bonus collector being positioned at a lower end of said playing surface and including means for displaying collected game tokens to said player;

a return for collecting game tokens that do not have a path achieving at least one of said goals:

a token dispenser for dispensing said game tokens of said monetary value collected in said return to said player when none of said desired goals are achieved; and an award dispenser for automatically dispensing a non-monetary award when one or more of said desired goals is achieved.

2. A guaranteed award dispensing game apparatus as recited in claim 1 wherein said game tokens are coins.

3. A guaranteed award dispensing game apparatus as recited in claim 1 wherein said non-horizontal playing surface includes a first end and a second end and a plurality of obstacles which deflect said game tokens when said game tokens move across said playing surface from said first end to said second end.

4. A guaranteed award dispensing game apparatus as recited in claim 1 wherein said award dispensed by said award dispenser includes redemption tickets.

5. A guaranteed award dispensing game apparatus as recited in claim 1 wherein said bonus collector further includes a mechanism for accumulating a progressive bonus score and a mechanism to allow a player to achieve a desired progressive goal to obtain a bonus award based upon said progressive bonus score.

6. A guaranteed award dispensing game apparatus as recited in claim 1 further comprising a progressive bonus apparatus for accumulating a progressive score contributed to by a plurality of said guaranteed award dispensing game apparatuses.

7. A guaranteed-award arcade game comprising:

a token accepting mechanism for accepting one or more game tokens from a player, said token accepting mechanism including a coin slot, said game tokens having a monetary value;

a playing surface receptive to said accepted game tokens, said playing surface including an upper end and a lower end and being inclined such that said upper end is higher than said lower end, said coin slot positioned above said upper end;

a guiding member movably arranged within said arcade game so as to influence the direction of movement of said game tokens on said playing surface, said guiding member including a rotatable member having an angular position controllably positioned by said player p guide said game tokens in desired directions across said playing surface;

a plurality of targets positioned relative to said playing surface and engageable by said game tokens, wherein at least one of said targets includes an aperture in said playing surface into which one or more of said game tokens may fall;

a bonus collector positioned relative to said playing surface, said bonus collector being engageable by said game tokens that do not engage said targets and operable to collect game tokens which engage it and to keep a progressive bonus score, wherein said bonus collector is positioned at said lower end of said playing surface are includes means for displaying collected game tokens to said player;

an award dispenser coupled to said plurality of targets and said bonus collector, said award dispenser being operative to dispense a non-monetary award to said player under any one of three conditions, said three conditions being:

(i) when a predetermined plurality of said targets have been engaged by one or more of said game tokens, wherein said non-monetary award is proportional to said progressive bonus score;

(ii) when one of said game tokens engages said bonus collector; or (iii) when one of said game tokens engages one of said targets; and a return positioned relative to said playing surface, said return being operative to engage said game tokens that do not engage said targets and said bonus collector and subsequently to dispense a returned token of said monetary value to said player, wherein said return includes an aperture positioned near a lower end of said playing surface for receiving said game tokens and a mechanism for returning said token to said player, and wherein said returned token is said accepted game token that does not engage said targets and said bonus collector.

8. A guaranteed-award arcade game as recited in claim 7 wherein said game tokens are coins.

9. A guaranteed-award arcade game as recited in claim 7 wherein said playing surface includes a plurality of obstacles positioned thereon for deflecting said playing pieces as said playing pieces move down said playing surface from said upper to lower ends under the influence of gravity.

10. A guaranteed-award arcade game as recited in claim 9 wherein said plurality of obstacles includes a plurality of pins extending in a direction substantially perpendicular to said playing surface.

11. A guaranteed-award arcade game as recited in claim 7 wherein at least one of said targets includes an aperture in said playing surface into which one or more of said playing pieces may fall.

12. A guaranteed-award arcade game as recited in claim 7, wherein said non-monetary awards are tickets, and further comprising an award dispenser for providing said non-monetary awards to said player.

13. A guaranteed-award arcade game as recited in claim 7 further comprising a plurality of said arcade games and a progressive bonus apparatus coupled to said plurality of arcade games, said progressive bonus apparatus accumulating a progressive apparatus score contributed to by said plurality of guaranteed arcade games.

14. A method for playing an arcade game that allows players to either win an award or receive their money back, the method comprising:

receiving a game coin from a player to start a game;

providing a playing surface;

causing one or more game pieces to move across said playing surface;

providing a guide controllable by said player;

allowing the player to influence the movement of said game pieces across said playing surface with said guide;

providing one or more award goals, said award goals being met when one or more of said game pieces engages one or more of said award goals, wherein said award goals include at least one aperture means for receiving one or more of said playing pieces and for sensing where one or more of said playing pieces is received;

providing a bonus collector, said bonus collector being operative to collect one or more of said game pieces from said playing surface which engage said collector, wherein said game pieces collected by said bonus collector are displayed to said player and are collected over a plurality of said games;

providing a non-monetary award to said player if one or more award goals are met;

providing a non-monetary award to said player if one or more of said game pieces are received by said bonus collector;

dispensing a bonus award based on one or more game pieces collected by said bonus collector of a progressive goal is achieved when a predetermined plurality of said award goals are met; and dispensing a returned coin to said player if no award goals are met, said returned coin having the equivalent monetary value as said game coin.

15. A method as recited in claim 14 wherein said game coin and said returned coin are the same coin.

16. A method as recited in claim 15 wherein said playing pieces are game coins.

17. A method as recited in claim 14 wherein said playing surface has a first end and a second end, and is inclined with respect to said first and second ends.

18. A method as recited in claim 14 further comprising dispensing said returned coin if no award goals are met and if said game piece is not returned by said bonus collector.

19. A method as recited in claim 14 further comprising providing a progressive bonus apparatus coupled to a plurality of said arcade games, wherein said progressive bonus apparatus increases a progressive apparatus score when a player operates one of said arcade games and provides an award based upon said progressive apparatus score to a winning player when said winning player achieves a progressive goal during a game.

20. A progressive goal game for a player comprising:

means for accepting a game token from said player, said game token having a monetary value;

a playing surface;

a playing piece moveably urged across said playing surface, said playing piece having a motion;

guide means for guiding said motion of said playing piece on said playing surface, said guide means being controllable by said player, wherein said guide means includes a rotatable guide that interrupts and redirects, said motion of said playing as said playing piece moves down an incline of said playing surface;

obstacle means for influencing said motion of said playing piece on said playing surface;

target means for receiving a playing piece from said playing surface, said target means having a plurality of targets, wherein said target include apertures in said playing surface, said apertures being sized to receive said playing piece;

collector means for collecting a plurality of playing pieces from said playing surface;

return means for returning said game token to said player if said playing piece is not received by said target means or collected by said collector means;

award means for awarding a non-monetary award to said player if said playing piece is received by said target means or collected by said collector means; and bonus collector means for collecting playing pieces that engage it and for providing a bonus to said player if a plurality of said playing pieces are received by a predetermined plurality of said targets, wherein said bonus collector means includes means for displaying said collected playing pieces to said player.

21. A progressive goal game as recited in claim 20 wherein said obstacle means includes pins extending outwardly from said playing surface.

* * * * *